US005153642A

United States Patent [19]

Folkins et al.

[11] Patent Number: 5,153,642

[45] Date of Patent: Oct. 6, 1992

[54] FIBER CLEANING SYSTEM FOR A DEVELOPMENT SYSTEM

[75] Inventors: Jeffrey J. Folkins, Rochester; Don B. Jugle, Penfield, both of N.Y.

[73] Assignee: Xerox Corporation, N.Y.

[21] Appl. No.: 737,128

[22] Filed: Jul. 29, 1991

[51] Int. Cl.[5] ..... G03G 21/00

[52] U.S. Cl. ..... 355/215; 118/652; 118/245

[58] Field of Search ..... 355/215, 245, 247, 259, 355/261; 118/652, 654, 656

[56] References Cited

U.S. PATENT DOCUMENTS

| | | | |
|---|---|---|---|
| 3,739,748 | 6/1973 | Rittler et al. | 355/259 X |
| 3,872,826 | 3/1975 | Hanson | 355/245 X |
| 4,078,520 | 3/1978 | Wilson | 118/646 |
| 4,267,245 | 5/1981 | Wada | 430/97 |
| 4,387,982 | 6/1983 | Stanley | 355/215 |
| 4,639,115 | 1/1987 | Lin | 355/245 |
| 4,809,035 | 2/1989 | Allen, Jr. | 355/298 |
| 4,984,019 | 1/1991 | Folkins | 355/215 |

*Primary Examiner*—Fred L. Braun

[57] ABSTRACT

An apparatus in which an elecrostatic latent image recorded on a photoconductive member is developed with developer material stored in a developer housing. The developer material advances along a path of travel to a development zone closely adjacent to the latent image. A cleaner, positioned in the path of the developer material and spaced from the photoconductive member, cleans contaminants from the developer material without impeding the flow thereof. The cleaner has a multiplicity of fibers disposed in the path of travel of the developer material.

12 Claims, 2 Drawing Sheets

FIBER CLEANING SYSTEM FOR A DEVELOPMENT SYSTEM

This invention relates generally to an electrophotographic printing machine, and more particularly concerns a developer unit in which developer material is cleaned to remove contaminants therefrom.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an AC voltage is applied to the donor roller detaching toner from the donor roll and projecting the toner toward the photoconductive member so that the electrostatic fields generated by the latent image attract the toner to develop the latent image. Single component development systems appear to offer advantages in low cost and design simplicity. However, the achievement of high reliability and easy manufacturability of the system may present a problem. Two component development systems have been used extensively in many different types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. A combination of these systems was described at the 2nd International Congress on Advances in Non-impact Printing held in Washington, D.C. on Nov. 4–8, 1984, sponsored by the Society for Photographic Scientists and Engineers. At that time, Toshiba described a development system using a donor roll and a magnetic roller. The donor roll and magnetic roller were electrically biased. The magnetic roller transported a two component developer material to the nip defined by the donor roll and magnetic roller. Toner is attracted to the donor roll from the magnetic roll. The donor roll is rotated synchronously with the photoconductive drum with the gap between them being about 0.20 millimeters. The large difference in potential between the donor roll and latent image recorded on the photoconductive drum causes the toner to jump across the gap from the donor roll to the latent image so as to develop the latent image. In developer units of this type, performance and resulting image quality are dependent upon the presence of contamination and debris. Contaminating fibers from many sources are frequently found on the photoconductive member. Many of these contaminating fibers migrate into the developer unit. In addition, airborne fibers can enter into the developer unit. Once in the developer unit, these fibers can be developed image wise on the photoconductive member. Scavengeless developer units are particularly sensitive to the presence of fibers on the donor roll. These fibers and other debris may be caught by the electrode wires. If fibers and debris are caught by the electrode wires, the flow of toner particles past the electrostatic latent image is sufficiently distorted that noticeable non-uniform streak wise deposits of toner are deposited on the photoconductive member and subsequently transferred to the copy sheet. Thus, it is desirable to remove fiber contaminants and debris from the flowing developer material. Various type of approaches have been used to remove contaminants and particles from developer units as illustrated by the following disclosures, which may be relevant to certain aspects of the present invention:

U.S. Pat. No. 4,078,520;
Patentee: Wilson;
Issued: Mar. 14, 1978
U.S. Pat. No. 4,267,245;
Patentee: Wada;
Issued: May 12, 1981
U.S. Pat. No. 4,809,035;
Patentee: Allen, Jr.;
Issued: Feb. 28, 1989

The relevant portions of the foregoing disclosures may be briefly summarized as follows:

U.S. Pat. No. 4,078,520 discloses a developer unit in which developer depleted is returned to the sump of the developer housing from the photoreceptor by gravity. The depleted developer is directed by a guide plate to a screen. The developer impacting the screen passes through the screen and through a sensor. The sensor detects toner density and actuates a toner dispenser to discharge toner into the sump of the developer housing.

U.S. Pat. No. 4,267,245 described a method of removing foreign material from magnetic developers. Magnetic developers are intermittently supplied to the peripheral surface of a non-magnetic sleeve. The supplied developer travels along the peripheral surface of the sleeve by rotating a magnet. Non-contaminated developer is recovered at a position a distance away from the supply of developer material.

U.S. Pat. No. 4,809,035 discloses removing non-magnetic particles from a supply of single component magnetic toner descending from a toner hopper. Separation is achieved by providing a partly closed unwanted particle chamber extending along an entire width of the hopper adjacent and below a feed roller and below a hopper outlet. A source of negative air flow is established across the entire width of the hopper and across the entire length of the unwanted particle chamber so as to draw the unwanted particles from the unwanted particle chamber. An air manifold is located on the developer unit housing.

In accordance with one aspect of the present invention, there is provided an apparatus for developing a latent image recorded on a surface with developer material. The apparatus includes a housing defining a chamber storing a supply of developer material. Means are provided for advancing the developer material along a path of travel to a development zone closely adjacent to the surface so as to develop the latent image recorded thereon. Means, spaced from the surface and located in the chamber of the housing, clean contaminants from the developer material without substantially impeding the advancing developer material. The cleaning means comprises a plurality of elongated fibers disposed in the path of travel of the developer material.

Pursuant to another aspect of the present invention, there is provided an electrophotographic printing machine of the type in which an electrostatic latent image recorded on a photoconductive member is developed to form a visible image thereof. The improvement includes a housing defining a chamber storing a supply of developer material. Means are provided for advancing the developer material along a path of travel to a development zone closely adjacent to the photoconductive member so as to develop the latent image recorded thereon. Means, spaced from the photoconductive member and located in the chamber of the housing, clean contaminants from the developer material without substantially impeding the advancing developer material. The cleaning means comprises a plurality of elongated fibers disposed in the path of travel of the developer material.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
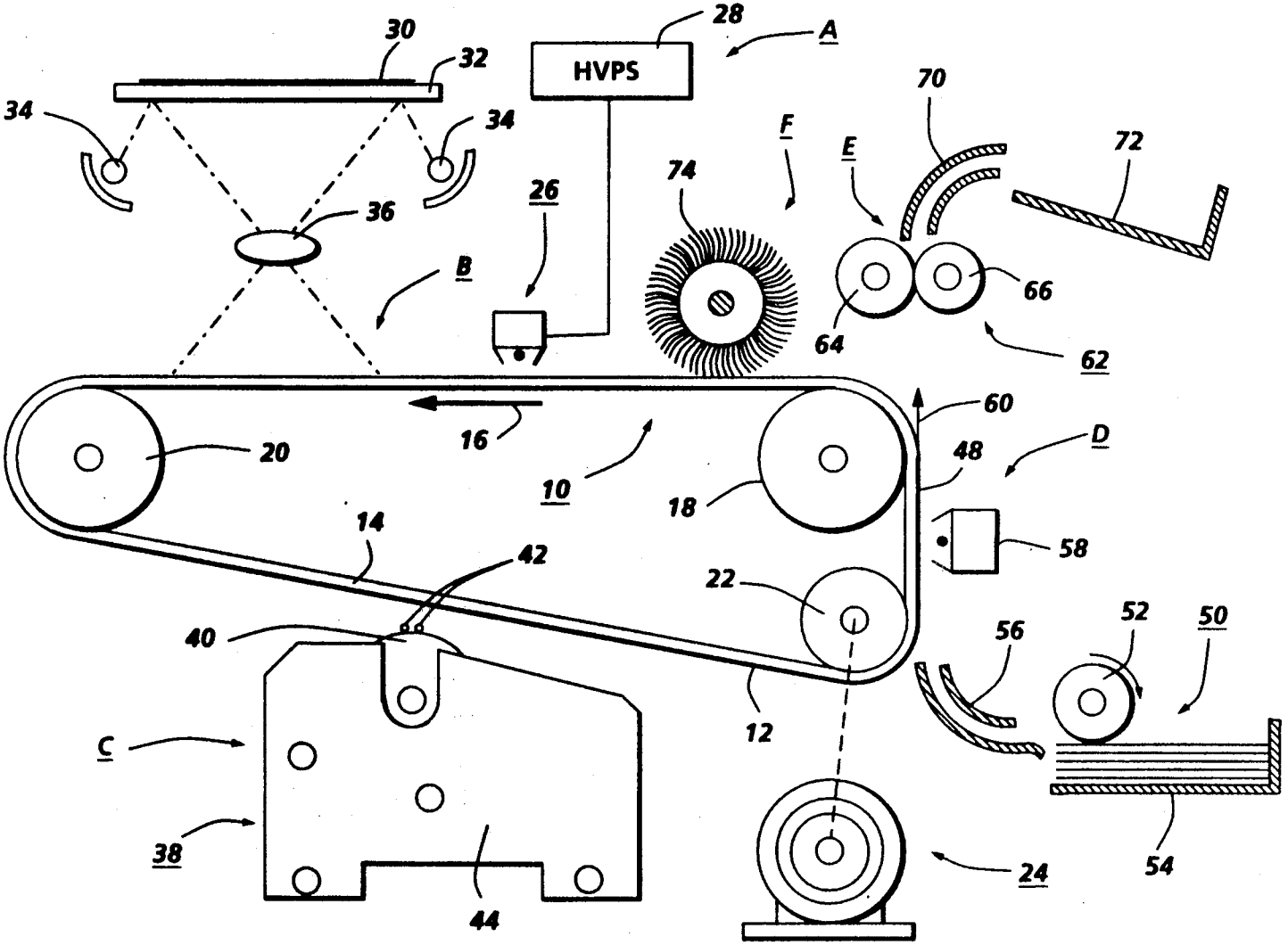
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roller 40 and electrode wires 42. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller. The development apparatus will be discussed hereinafter, in greater detail, with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 2:
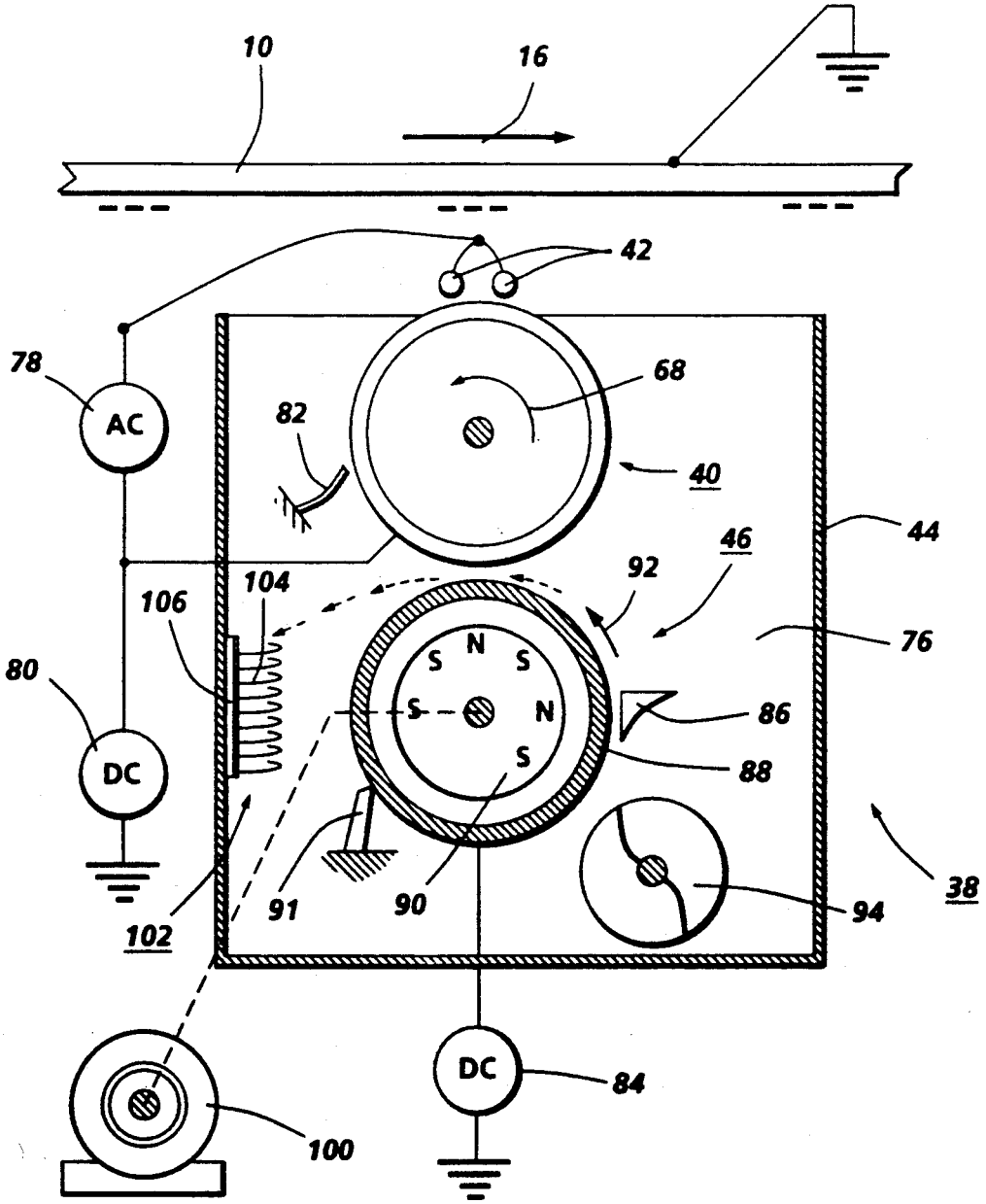
FIG. 2 is a schematic elevational view showing the developer unit used in the FIG. 1 printing machine.

Referring now to FIG. 2, there is shown developer unit 38 in greater detail. As shown thereat, developer unit 38 includes a housing 44 defining a chamber 76 for storing a supply of developer material therein. Donor roller 40, electrode wires 42 and magnetic roller 46 are mounted in chamber 76 of housing 44. The donor roller can be rotated in either the 'with' or 'against' direction relative to the direction of motion of belt 10. In FIG. 2, donor roller 40 is shown rotating in the direction of arrow 68. Similarly, the magnetic roller can be rotated in either the 'with' or 'against' direction relative to the direction of motion of belt 10. In FIG. 2, magnetic roller 46 is shown rotating in the direction of arrow 92. Donor roller 40 is preferably made from anodized aluminum.

Developer unit 38 also has electrode wires 42 which are disposed in the space between the belt 10 and donor roller 40. A pair of electrode wires are shown extending in a direction substantially parallel to the longitudinal axis of the donor roller. The electrode wires are made from one or more thin (i.e. (50 to 100$\mu$ diameter) stainless steel wires which are closely spaced from donor roller 40. The distance between the wires and the donor roller is approximately 25$\mu$ or the thickness of the toner layer on the donor roll. The wires are self-spaced from the donor roller by the thickness of the toner on the donor roller. The ends of the wires are supported by the tops of end bearing blocks which may also support the donor roller for rotation. The wire extremities are attached so that they are slightly below a tangent to the surface, including toner layer, of the donor structure. Mounting the wires in such a manner makes them insensitive to roll runout due to their self-spacing.

As illustrated in FIG. 2, an alternating electrical bias is applied to the electrode wires by an AC voltage source 78. The applied AC establishes an alternating electrostatic field between the wires and the donor roller which is effective in detaching toner from the surface of the donor roller and forming a toner cloud about the wires, the height of the cloud being such as not to be substantially in contact with the belt 10. The magnitude of the AC voltage is relatively low and is in the order of 200 to 600 volts peak at a frequency rangig from about 3 kHz to about 10 kHz. A DC bias supply 80 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. At a spacing ranging from about 10$\mu$ to about 40$\mu$ between the electrode wires and donor roller, an applied voltage of 200 to 600 volts produces a relatively large electrostatic field without risk of air breakdown. The use of a dielectric coating on either the electrode wires or donor roller helps to prevent shorting of the applied AC voltage. Blade 82 strips all of the toner from donor roller 40 after development so that magnetic roller 46 meters fresh toner to a clean doner roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member or sleeve 88 made preferably from aluminum and having the exterior circumferential surface thereof roughened. An elongated multiple magnet 90 is positioned interiorly of and spaced from sleeve 88. Elongated magnet 90 is mounted stationarily. Motor 100 rotates sleeve 88 in the direction of arrow 92. Developer material is attracted to sleeve 88 and advances therewith into the nip defined by donor roller 40 and magnetic roller 46. Toner particles are attracted from the carrier granules on the magnetic roller to the donor roller. Scraper blade 91 removes denuded carrier granules and extraneous developer material from the surface of sleeve 88.

With continued reference to FIG. 2, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a low permeability magnetic core having a thin layer overcoat with layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any suitable developer material having at least carrier granules and toner particles may be used.

Developer material advances with tubular member 88 in the direction of arrow 92. Toner particles advance with donor roller 40 in the direction of arrow 68. Any contaminants and/or debris move with the toner particles and developer material in the direction of arrows 92 and 68. The toner particles, developer material, contaminants and debris flow through a cleaner, indicated generally by the reference numeral 102. Cleaner 102 includes a multiplicity of fibers 104 mounted on a support 106. Support 106 is mounted removably on a side wall of developer housing 44. By way of example, support 106 may be mounted slidably in rails secured to the side wall housing 44. In this way, an operator may readily remove cleaner 102 from developer housing 44 at selected maintenance intervals. Fibers 104 have hooks at the free ends thereof. The hooks are oriented with the bent end pointing up against the direction of flow of the toner particles, developer material, contaminants and debris. Thus, cleaner 102 is oriented vertically. However, there are many other orientations and positions which will operate equally satisfactorily depending upon the configuration of the developer housing. Further details of cleaner 102 are shown in FIG. 3.

Figure 3:
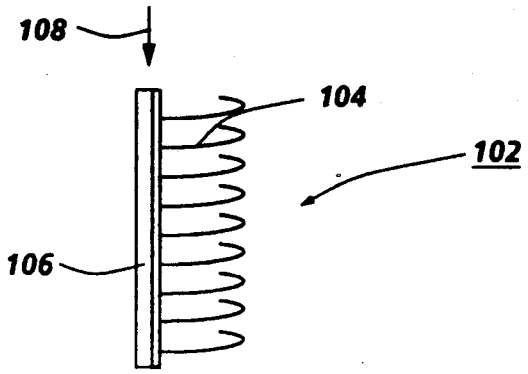
FIG. 3 is a schematic elevational view illustrating the cleaning fibers used in the FIG. 2 developer unit to remove contaminants from the flowing developer material.

Turning now to FIG. 3, cleaner 102 is shown in greater detail. Cleaner 102 is shown oriented vertically with the toner particles, developer material, contaminants and debris flowing in the direction of arrow. Fibers 104 orient themselves with their Stokes diameter (usually their maximum dimension) perpendicular to the flow direction. This offers the maximum probability of capture by the hooks on the free ends of fibers 104. In general, the cleaner should be mounted in near vertical position so that developer material and toner particles can flow easily, thereby maintaining a high flux of contaminated developer material flowing through it. The hooks offer some impedance, but do not totally inhibit the flow. Therefore, cleaner 102 can be mounted at an orientation other than the vertical depending upon the flow angle of the developer material, the pile density of the fibers, their diameter and length. Fibers have a hook part of the type decribed herein are made and sold under the registered trademark "Velcro". These fibers and their method of manufacture are described more fully in U.S. Pat. Nos. 2,717,437 and 3,009,235, the relevant portions thereof being hereby incorporated into the present application. Cleaner 102 is woven to form a strong backing sheet of fabric with a loop pile made of monofilaments of a heat settable material such as "Nylon" a registered trademark. The loop pile is heat set and thereafter each separate loop is cut transversely of one leg at a point below the crest of the loop so as to form an individually vertically disposed hook from each loop. The backing sheet is adhesively secured to support 106.

In recapitulation, it is evident that the developer unit of the present invention includes an operator removable cleaner positioned in the path of flow of the developer material to remove contaminants and debris therefrom. The cleaner includes a multiplicity of fibers secured to a rigid support. Each fiber has a hook on the free end thereof. In this way, the fibers trap contaminants while permitting the developer material to flow freely therethrough. The support is mounted slidably on a wall of the developer housing.

It is, therefore, apparent that there has been provided in accordance with the present invention, a developer unit that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for developing a latent image recorded on a surface with developer material including:

a housing defining a chamber storing a supply of developer material;

means for advancing the developer material along a path of travel to a development zone so as to develop the latent image recorded on the surface;

means, spaced from the surface and located in the chamber of said housing, for cleaning contaminants from the developer material without substantially impeding the advancing developer material, said cleaning means comprising a plurality of elongated fibers disposed in the path of travel of the developer material with each of the elongated fibers of said cleaning means including a hook.

2. An apparatus according to claim 1, wherein said cleaning means is located after the development zone in the path of travel of the advancing developer material.

3. An apparatus according to claim 1, wherein said cleaning means is operator removable from the chamber of said housing.

4. An apparatus according to claim 1, wherein said advancing means includes:

a donor member spaced from the surface and adapted to transport developer material to the development zone adjacent the surface;

means for transporting developer material to said donor member; and an electrode member positioned in the development zone between the surface and said donor member, said electrode member being electrically biased to detach toner from said donor member so as to form a toner cloud in the development zone with detached toner from the toner cloud developing the latent image.

5. An apparatus according to claim 4, wherein said donor member includes a roll.

6. An apparatus according to claim 5, wherein said electrode member includes a plurality of small diameter wires.

7. An electrophotographic printing machine of the type in which an electrostatic latent image recorded on a photoconductive member is developed to form a visible image thereof, wherein the improvement includes:

a housing defining a chamber storing a supply of developer material;

means for advancing the developer material along a path of travel to a development zone so as to develop the latent image recorded on the photoconductive member; and means, spaced from the photoconductive member and located in the chamber of said housing, for cleaning contaminants from the developer material without substantially impeding the advancing developer material, said cleaning means comprising a plurality of elongated fibers disposed in the path of travel of the developer material with each of the elongated fibers of said cleaning means including a hook.

8. A printing machine according to claim 7, wherein said cleaning means is located after the development zone in the path of travel of the advancing developer material.

9. A printing machine according to claim 7, wherein said cleaning means is operator removable from the chamber of said housing.

10. A printing machine according to claim 7, wherein said advancing means includes:

a donor member spaced from the photoconductive member and adapted to transport developer material to the development zone adjacent the photoconductive member;

means for transporting developer material to said donor member; and an electrode member positioned in the development zone between the photoconductive member and said donor member, said electrode member being electrically biased to detach toner from said donor member so as to form a toner cloud in the development zone with detached toner from the toner cloud developing the latent image.

11. A printing machine according to claim 10, wherein said donor member includes a roll.

12. A printing machine according to claim 11, wherein said electrode member includes a plurality of small diameter wires.

* * * * *